US005979315A

United States Patent [19]

Haan et al.

[11] Patent Number: 5,979,315

[45] Date of Patent: Nov. 9, 1999

[54] FLEXOGRAPHIC PRINTING SELECTIVELY

[75] Inventors: Henk Haan, Niagara Falls; Charles Gerace, Cheektowaga, both of N.Y.

[73] Assignee: Moore U.S.A., Inc., Grand Island, N.Y.

[21] Appl. No.: 09/166,218

[22] Filed: Oct. 5, 1998

[51] Int. Cl.[6] ..... B41F 13/24; B41F 11/00

[52] U.S. Cl. ..... 101/181; 101/485

[58] Field of Search ..... 101/91, 92, 181, 101/183, 180, 182, 184, 185, 136, 138, 216, 218, 247, 248, 219, 483, 484, 485, 490; 83/300; 270/1.01

[56] References Cited

U.S. PATENT DOCUMENTS

| | | | |
|---|---|---|---|
| 1,653,199 | 12/1927 | Belcher | 101/177 |
| 3,697,101 | 10/1972 | Loos et al. . | |
| 3,892,427 | 7/1975 | Kraynak et al. . | |
| 3,899,381 | 8/1975 | O'Brien et al. . | |
| 3,911,818 | 10/1975 | Macllvane . | |
| 3,913,719 | 10/1975 | Frey . | |
| 3,982,744 | 9/1976 | Kraynak et al. . | |
| 3,982,746 | 9/1976 | O'Brien et al. . | |
| 3,993,299 | 11/1976 | O'Brien et al. . | |
| 3,994,225 | 11/1976 | Sitzberger . | |
| 4,531,828 | 7/1985 | Hoshino | 101/181 |
| 4,789,147 | 12/1988 | Berger et al. . | |
| 4,805,501 | 2/1989 | Nuttin . | |
| 4,966,352 | 10/1990 | Nuttin . | |
| 4,989,850 | 2/1991 | Weller . | |
| 5,030,977 | 7/1991 | Hanson et al. . | |
| 5,114,128 | 5/1992 | Harris, Jr. et al. . | |
| 5,114,291 | 5/1992 | Hefty . | |
| 5,117,610 | 6/1992 | Hartman et al. . | |
| 5,297,488 | 3/1994 | Bunch, Jr. . | |
| 5,429,698 | 7/1995 | Hartman et al. . | |
| 5,520,109 | 5/1996 | Meschi . | |

FOREIGN PATENT DOCUMENTS

| | | |
|---|---|---|
| 0 527 552 | 2/1993 | European Pat. Off. . |
| 0 569 633 | 11/1993 | European Pat. Off. . |
| 0587322 | 3/1994 | European Pat. Off. . |
| 0 594 989 | 5/1994 | European Pat. Off. . |
| 0 175 516 | 3/1996 | European Pat. Off. . |
| 01240423 | 12/1993 | Italy . |
| 1 214 639 | 12/1970 | United Kingdom . |
| 1498981 | 1/1978 | United Kingdom . |
| 2 161 752 | 1/1986 | United Kingdom . |
| WO 92/09435 | 6/1992 | WIPO . |
| WO 92/20525 | 11/1992 | WIPO . |
| WO 94/00298 | 6/1994 | WIPO . |
| WO 96/19352 | 6/1996 | WIPO . |

OTHER PUBLICATIONS

Stobbe, "Ion Deposition Printing", *FLEXO*, Dec. 1993, pp. 76and 77.

"The Highly Variable Image of Information Technology", *Forms International*, Mar. 1993, two pages.

One page flyer entitled "Printger Perect Massive Mailings".

"Printer Allows Variable Info In Single Pass", *Paper Film & Foil Converter*, Jul. 1991, one page.

Blanchard, "Developments in non–impact printing", *Upfront Piratechnics*, p. 10.

"High–speed ink jet systems are launched by Videojet Graphics", Videojet, one page.

"Edward Keller marks the spot", *Labels*, two pages.

"Moore's prototype has varied applications", *Printing World*, Aug. 9, 1999, one page.

*The Philadelphia Daily News* (File 731) and *The Philadelphia Inquirer* (File 633), pp. 196 & 197.

*Primary Examiner*—J. Reed Fisher

*Attorney, Agent, or Firm*—Nixon & Vanderhye P.C.

[57] ABSTRACT

A flexographic unit printing assembly and method of printing a web of paper using the assembly eliminates the need for one or more flexographic units without eliminating the capability to effectively print certain jobs. At least one of the flexographic print units is provided with a print plate having distinctly different first and second portions, and a computer control has two nodes connected to the first flexographic print unit, one for sending a command telling the unit to print substantially the entire length of the print plate, and the other sending a command to the first flexographic print unit telling it to print the web only with the first print portion, and then to operatively (e.g. mechanically) disengage the print plate from the web.

20 Claims, 4 Drawing Sheets

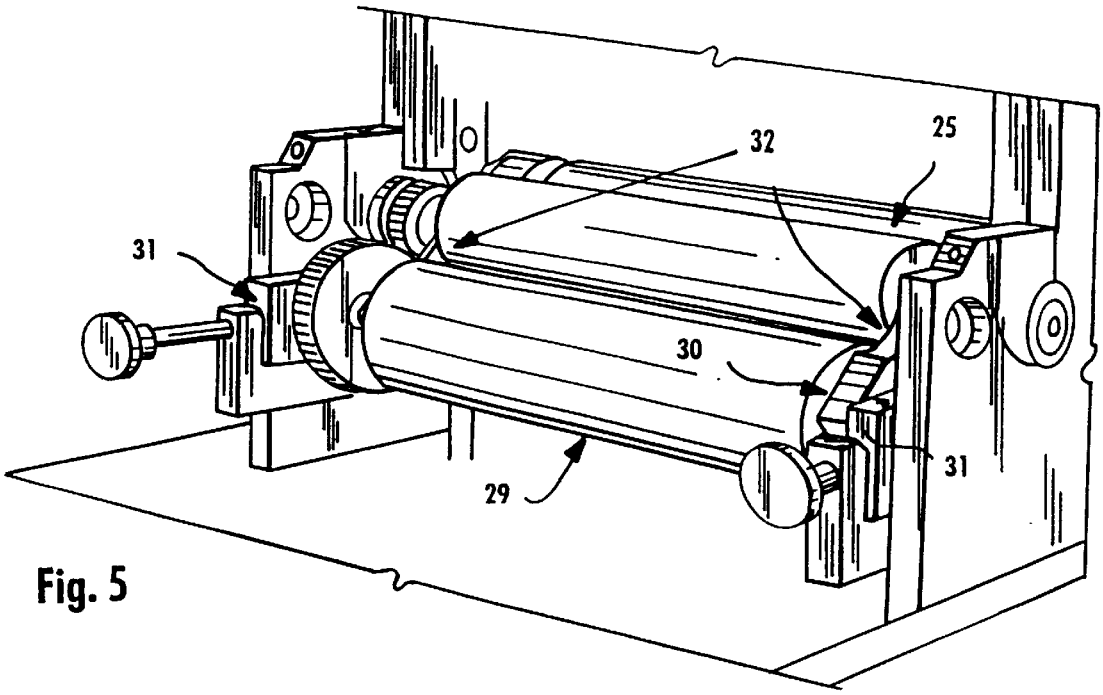
Fig. 5
Fig. 6
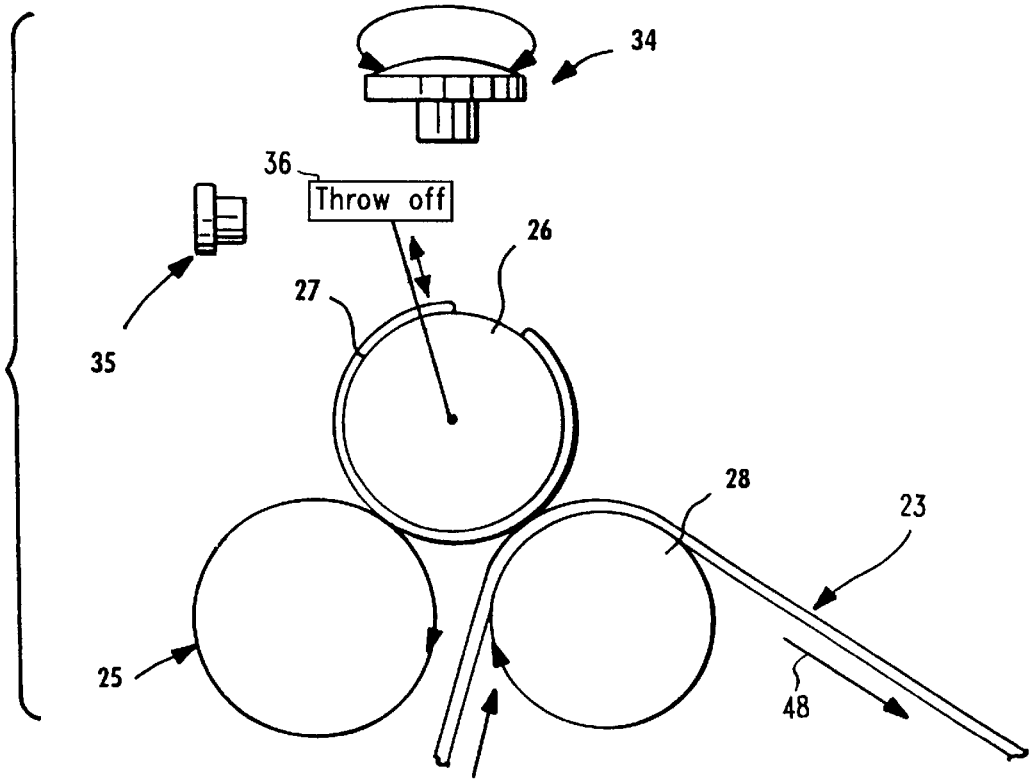

FLEXOGRAPHIC PRINTING SELECTIVELY

BACKGROUND AND SUMMARY OF THE INVENTION

In copending application Ser. No. 08/359,697 filed Dec. 20, 1994 (Attorney Docket 263-1278), and printed International Application WO 96/19352 (the disclosures of which are hereby incorporated by reference herein) a printing system and method are provided which are able to substantially simultaneously print a web of paper to produce discrete documents with selected non-variable information and vastly different variable information, rather than printing the variable and non-variable information at different locations. While the assembly and method set forth therein are highly functional, it has been found according to the present invention that under some circumstances, for certain types of print jobs, it is possible to eliminate one or more flexographic unit print decks associated with the printing system of the copending application—or for similar systems even if they do not include variable information printing at the same site—without sacrificing functionality. Elimination of, or the elimination of the operation of, one or more flexographic printing heads saves considerable setup time, money, and labor in the printing operations, and also can save significant capital investment if one or more units can be eliminated entirely, or dedicated for other purposes.

According to one aspect of the present invention a method of printing a web of paper using a plurality of flexographic print units, each having a flexible material print plate with a predetermined plate length, and for printing a full form depth, and using a computer control for the flexographic print units, at least a first of the flexographic print units printing plate having first and second continuous distinctly different print portions over the full form depth plate length, is provided. The method comprises: (a) at some points in time, sending print commands from the computer control unit to the flexographic print units, including the first flexographic print unit, to print the web with the predetermined plate length thereof; and (b) at different points in time sending a print command from a computer control to the first flexographic print unit to print the web with only the first print portion thereof, so that only part of a full form depth is printed by the first component, moving the first unit plate out of operative contact with the web after the first print portion of the plate prints the web.

In the practice of the method of the invention, there preferably is further (c) sending a command from the computer control to another of the flexographic print units, besides the first flexographic print unit, to print that part of the full form depth not printed with just the first print portion of the first print unit. In a preferred form of the method, a second of the flexographic print units has a second printing plate having first and second continuous distinctly different portions over the predetermined length thereof; and the method provides that (a) is practiced for the second flexographic print unit, and further comprises (d) at some points in time sending a print command from the computer control to the second flexographic print unit to print the web with only the first print portion of the second print plate so that only part of the full form depth is printed thereby, the second print unit print plate then moving out of operative contact with the web. Still further, the method of the invention further comprises (e) sending a command from the computer control to another of the flexographic print units besides the first and second flexographic print units to print that part of the form not printed by the first print plate portion of the second flexographic print unit.

In the practice of (b) of the method, the second portion of the print plate of the first flexographic print unit can be operatively disengaged by actually physically disengaging it from the web, such as by using a conventional throw-off. Also, the method may be practiced to print bills, and each form depth may be separated from the web to form a multi-page bill before sending (e.g. mailing) it to a customer. Also, according to the method (b) may be practiced to print a company or organization logo as the first print portion. Further, according to the method (b) may be practiced by printing a company or organization first logo portion of a first color with the first flexographic print unit first plate portion, and (d) may be practiced by printing a second portion of a company organization logo with a second color, different than the first color, and intermeshing with the first logo portion, with the second flexographic print unit print plate first portion.

According to another aspect of the present invention a printing assembly is provided comprising the following components: A plurality of flexographic print units each comprising an anilox roll, an impression cylinder and a plate cylinder having a flexible material plate, each plate having a plate length substantially corresponding to a full form length. A web passing through the flexographic print units between the impressing cylinder and plate cylinder of each. Means for operatively moving the plates mounted by the print cylinders into and out of print contact with the web to thereby either print or not print the web with each the plate. A computer control for sending print commands to each of the flexogrpahic print units moving means to selectively move the plates of each into or out of operative contact with the web, the computer control having a plurality of distinct nodes. At least a first of the print units having the plate thereof with first and second continuous distinctly different print portions each with a length significantly less than the full form depth. And the computer control having first and second distinct nodes of the plurality of nodes connected to the first flexographic print unit, the first node for sending a print command to the first flexographic print unit which effects printing of a substantially full form depth with the first unit print plate, and the second node for sending a print command to the first print unit which causes only the first portion of the first unit plate to print the web, less than a full form depth, and then for the first print unit print plate to move out of operative engagement with the web.

In the assembly described above a second of the flexographic print units may have the plate thereof with first and second continuous distinctly different portions each with a length significantly less than the full form depth; and wherein the computer control then has third and fourth distinct nodes of the plurality of nodes connected to the second flexographic print unit, for sending a print command to the second flexographic print unit which effects printing of a full form depth with the second unit print plate, and the fourth node for sending a print command to the second print unit which causes only the first portion of the second unit plate to print the web less than a substantially full form depth, and then for the second print unit print plate to move out of operative engagement with the web. The plurality of flexographic printing units preferably comprises at least two other flexographic printing units besides the first and second units. The means for operatively moving the plates mounted by the print cylinders into and out of operative contact with the web may comprise conventional means for actually moving the print cylinder, such as a throw-off, or may comprise a structure for moving the web away from the print cylinder, or not supplying ink to the second portion of the print plate in the case of the first and second flexographic print means, or other conventional structures for accomplishing that purpose.

Each flexographic print unit typically comprises an ink metering roll engaging an anilox roll, a compression cylinder, and a plate cylinder having a flexible material plate around at least part of the periphery thereof, the plate on the plate cylinder engaging the anilox roll, and the paper web passing between the plate on the plate cylinder and the impression cylinder. Also, the first print portions of the first and second print unit plates may comprise indicia which are intermeshing components, with different colored ink, of a company or organization logo.

It is a primary object of the present invention to provide a simplified cost effective method and print assembly for printing a web of paper using a plurality of flexographic print units. This and other objects of the invention will become clear from a detailed description of the invention and from the appended claims.

BRIEF DESCRIPTION OF THE DRAWINGS

FIG. 5 is a perspective view of a part of an exemplary flexographic printing unit according to the invention; and FIG. 6 is a schematic side view of some of the components from FIG. 5 shown in association with other portions of an exemplary flexographic printing unit according to the present invention.

DETAILED DESCRIPTION OF THE DRAWINGS

Figure 1:
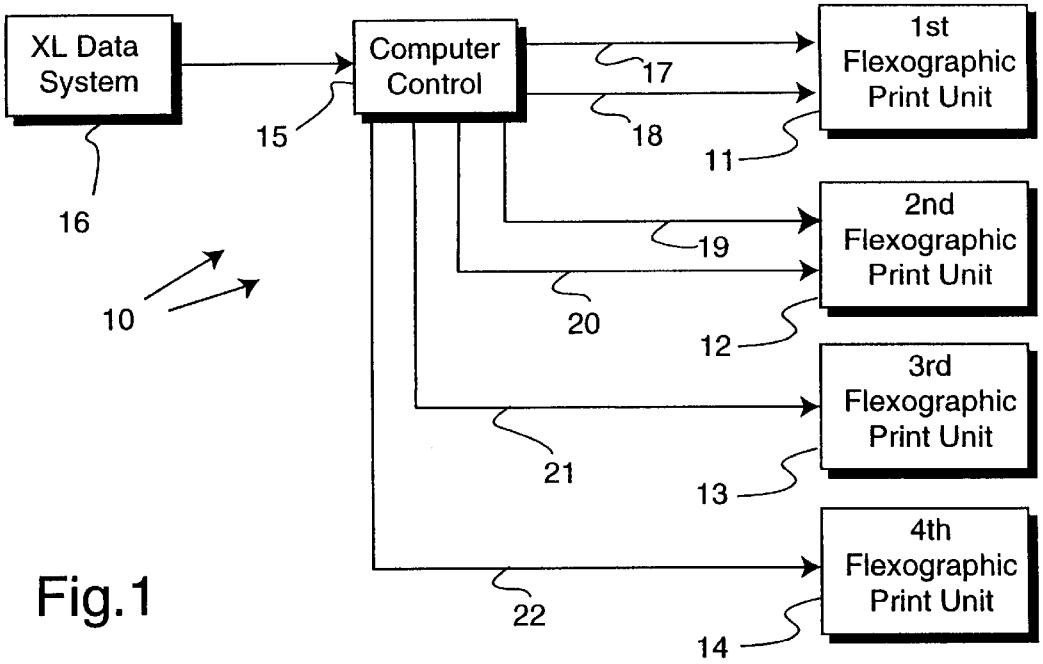
FIG. 1 is a schematic view illustrating the operative connection between a computer control and flexographic print units according to the invention.

FIG. 1 schematically illustrates a printing assembly shown generally by reference numeral 10, according to the present invention for practicing the method of printing a web of paper according to the invention. The system 10 includes a plurality of flexographic print heads, in the embodiment illustrated in first, second, third, and fourth flexographic printing units 11 through 14, respectively, controlled by a computer control 15, which is a microprocessor or other controller. In the preferred embodiment, the control 15 is operatively connected to a master control such as an XL Data System 16 available from Moore U.S.A., Inc. of Lake Forest, Ill., as described in the above mentioned copending application, and published International Application, which have been incorporated by reference herein. In the embodiment illustrated, two separate control paths or mechanisms 17, 18 are provided between controller 15 and first print unit 11, and two separate control paths or mechanisms 19, 20 between computer control 15 and the second flexographic print head unit 12, and a single path or mechanism 21, 22 between the computer control 15 and each of the third and fourth units 13, 14. It is to be understood that five or more print units may be provided, or only three, instead of the first through fourth units 11–14 illustrated in FIG. 1.

The flexographic units 11 through 14 may comprise part of a Webtron® 1000 3-color flexographic press, or may comprise other conventional flexographic units preferably all at the same site but optionally separated somewhat. While construction of the units 11–14 may vary somewhat, they basically are all conventional.

Typical components of each of the flexographic print units 11–14, are illustrated in somewhat more detail in FIGS. 5 and 6. Each of the units 11–14 preferably includes an anilox roll 25, a plate cylinder 26 having a rubber or like flexible material printing pates 27 (see FIG. 6) covering at least a part of the periphery thereof, and an impression cylinder 28. Ink is applied to the flexible printing plate 27 by the anilox roll 25, and ink is supplied to the anilox roll 25 using a conventional ink metering roll 29 (see FIG. 5). The roll 29 is typically neoprene covered and an ink wiper 30 is associated with it. Pressure blocks 31 provide adjustment for light contact between the ink metering roll 29 and the anilox roll 25, and plastic foam wiper blocks 32 are mounted in ink wiper pockets. A conventional doctor blade (not seen in FIG. 5) controls the ink between the rolls 29, 25.

The paper web 23 typically takes the path illustrated in FIG. 6 between the flexible printing plate 27 and the impression cylinder 28. Conventional vertical and horizontal adjustments are illustrated schematically in FIG. 6 by the vertical adjustment component 34 and the horizontal adjustment component 35. The conventional selective plate cylinder throw-off mechanism is illustrated schematically at 36 in FIG. 6, such a throw-off unit being associated with each of the flexographic print units 11–14.

Figure 3:
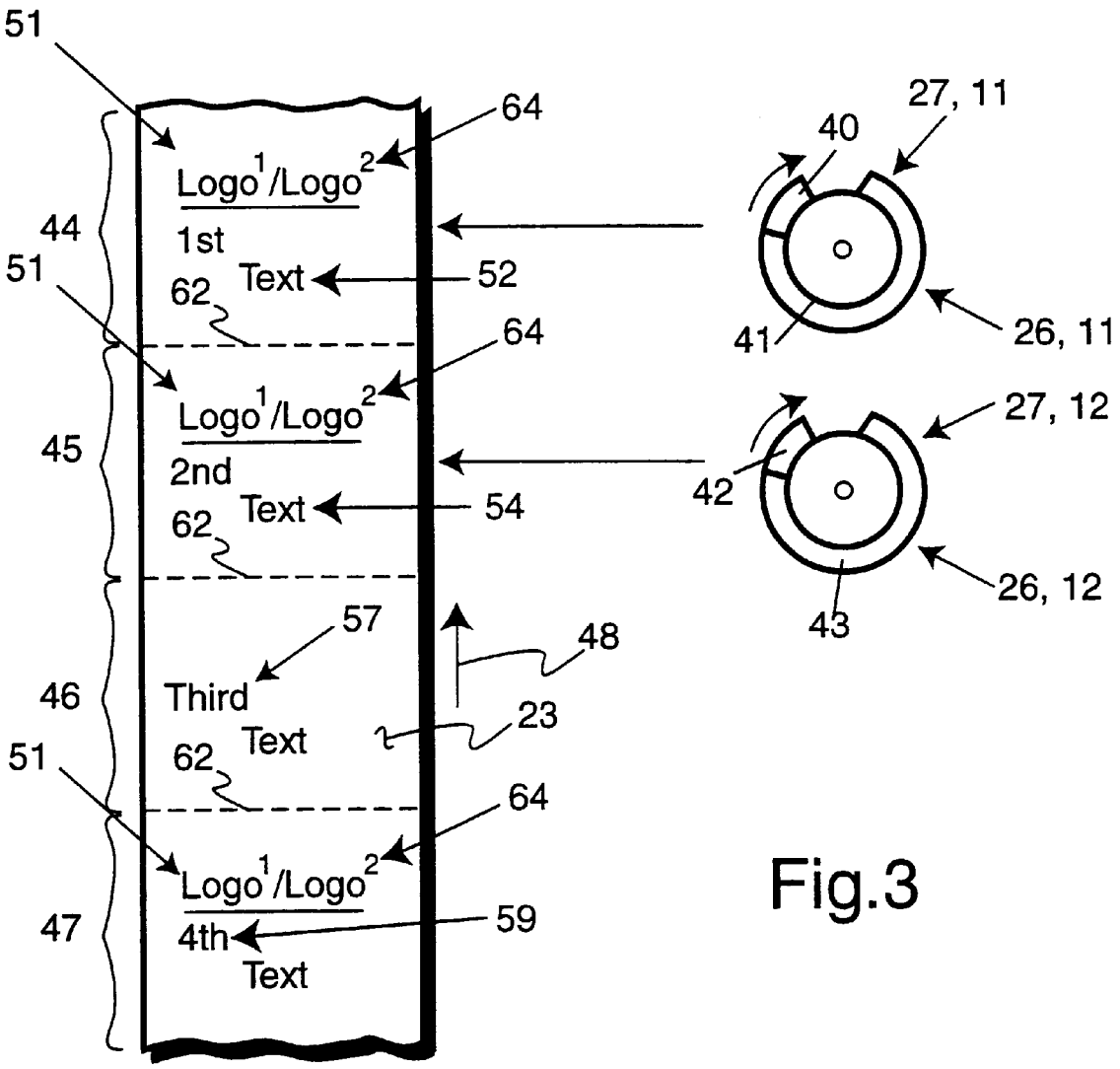
FIG. 3 is a schematic illustration of a web having forms printed thereon pursuant to an exemplary method according to the present invention and showing particular print cylinders according to the invention in schematic association therewith.

Instead of a conventional mechanical throw-off unit 36, the printing plate 27 on a plate cylinder 26 may be operatively disengaged from the web 23 by moving the web 23 with respect to the print cylinder 26, by not supplying ink to a portion of the plate 27, or at other conventional mechanisms. As schematically illustrated in FIG. 3, the first flexographic print unit print cylinder 26, 11 has a printing unit plate 27, 11 with first and second 40, 41, respectively continuous distinctly different print portions. The second flexographic print unit 12 cylinder 26, 12—as illustrated in FIG. 3—also may have a plate 27, 12 associated therewith having distinctly different first and second portions 42, 43, as also schematically illustrated in FIG. 3.

Figure 2:
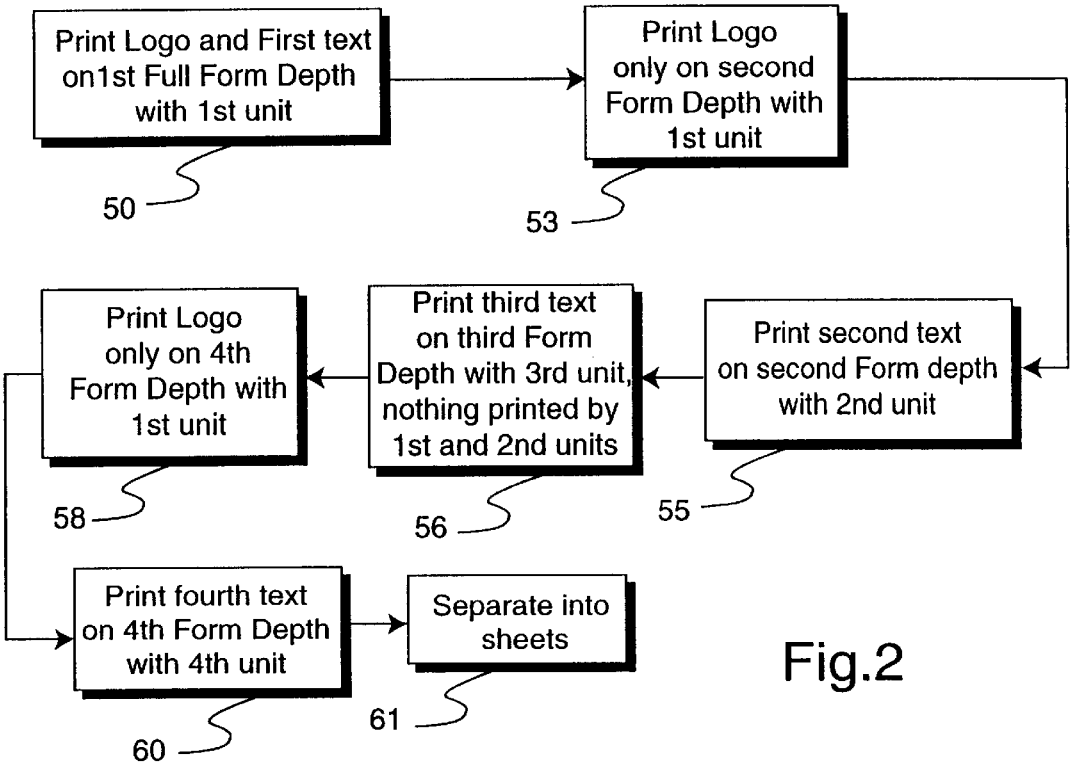
FIG. 2 is a box diagram illustrating the practice of an exemplary method according to the present invention.

FIG. 2 schematically illustrates how a method utilizing the printing assembly described above may be utilized in the printing of a web of paper 23 according to the invention, such as bills (like telephone bills) which may have logo and text printed on various form depths thereof. Note that each plate 27 has a length substantially corresponding to that of a form depth. The first form depth 44 illustrated in FIG. 3, and the form depths 44–47 also illustrated in FIG. 3, are preferably of substantially equal length, in the direction 48.

As seen in FIG. 2, as indicated by box 50, a logo and first text are printed on first full form depth 44 with the first flexographic print unit 11. The logo is illustrated at 51 in FIG. 3, and the first text schematically illustrated at 52 in FIG. 3. The logo 51 and text 52 are in a first color (e.g. red), and the logo 51 may be a company or organization logo or similar indicia provided on the first print portion 40 of the plate 27, 11. The text 52 may be numbers, words, and/or graphic elements such as lines, boxes, and/or designs and is printed by the second print portion 41 of the plate 27, 11, as seen in FIG. 3.

The next step of the method of FIG. 2, indicated by box 53, is to print the logo 51 only on the second form depth 45 with the first flexographic print unit 11. Then the second text 54 (see FIG. 3) is printed on the second form depth 45 with the second flexographic print unit 12 (or any of the other flexographic print units 13, 14, etc.) as indicated by box 55 in FIG. 2. The box 53 step is accomplished by the computer control 15 sending a signal to the first flexographic print unit 11 so that the second plate portion 41 of the plate 27 is moved operatively out of contact with the web 23, as by physically disengaging it from the web 23 by using a mechanical throw-off 36.

The exemplary method of FIG. 2 further comprises, as illustrated by the box 56, printing the third text 57 (see FIG. 3) on the third form depth 46 using the third flexographic print unit 13, followed by—in one example—the step of box 58 which indicates printing only the logo 51 on the fourth form depth 47 using first flexographic print unit 11 (in the manner described above with respect to box 53), and printing the fourth text 59 (see FIG. 3) with the fourth flexographic printing 14 on the fourth form depth 47, as illustrated schematically by box 60 in FIG. 2. Any of the units 11–14 can be used to repeat printing the text associated therewith on the web 23 for a particular assembly of form depths, with any combination with the logo 51 being printed on any particular sheet, and with the units 11–14 printing in any sequence. Ultimately, however, perhaps other form depths with just the logo 51 thereon and variable data (printed as described in the above mentioned copending application), or just variable data alone, will also be printed. Ultimately when all of the forms associated with a particular customer (e.g. when printing bills, such as telephone bills) or entity are complete, the individual forms, such as the forms 44–47 schematically illustrated in FIG. 3, will be separated from each other, as schematically illustrated by box 61 in FIG. 2. The separation may be by bursting, cutting, slitting, or any other conventional mechanism or procedure. The lines between various forms 44–47 illustrated schematically at 62 in FIG. 3 may be perforation lines, or indicator lines indicating when automatically sensed cutting may take place.

Though not described in FIG. 2, FIG. 3 also illustrates an embodiment in which the second flexographic print unit 12 has a plate 27 with distinctly different portions 42, 43, for example, the portion 42 printing what is indicated as "logo 2", shown generally by reference numeral 64, in FIG. 3. The logo 64 may be distinctly different than the logo 51, or it may be an intermeshed portion of a complete logo but of a different color. That is, for example, logo 51 may be red, and logo 64 blue, and be intermeshed to provide a unitary logo of a company, organization, or the like. The computer control 15 controls the second unit 12 just like it controls the first unit 11 to operatively move the printing plate 27 out of operative contact with the web 23 after just the first print portion 42 of the plate 27, 12 has printed, when desired.

Figure 4:
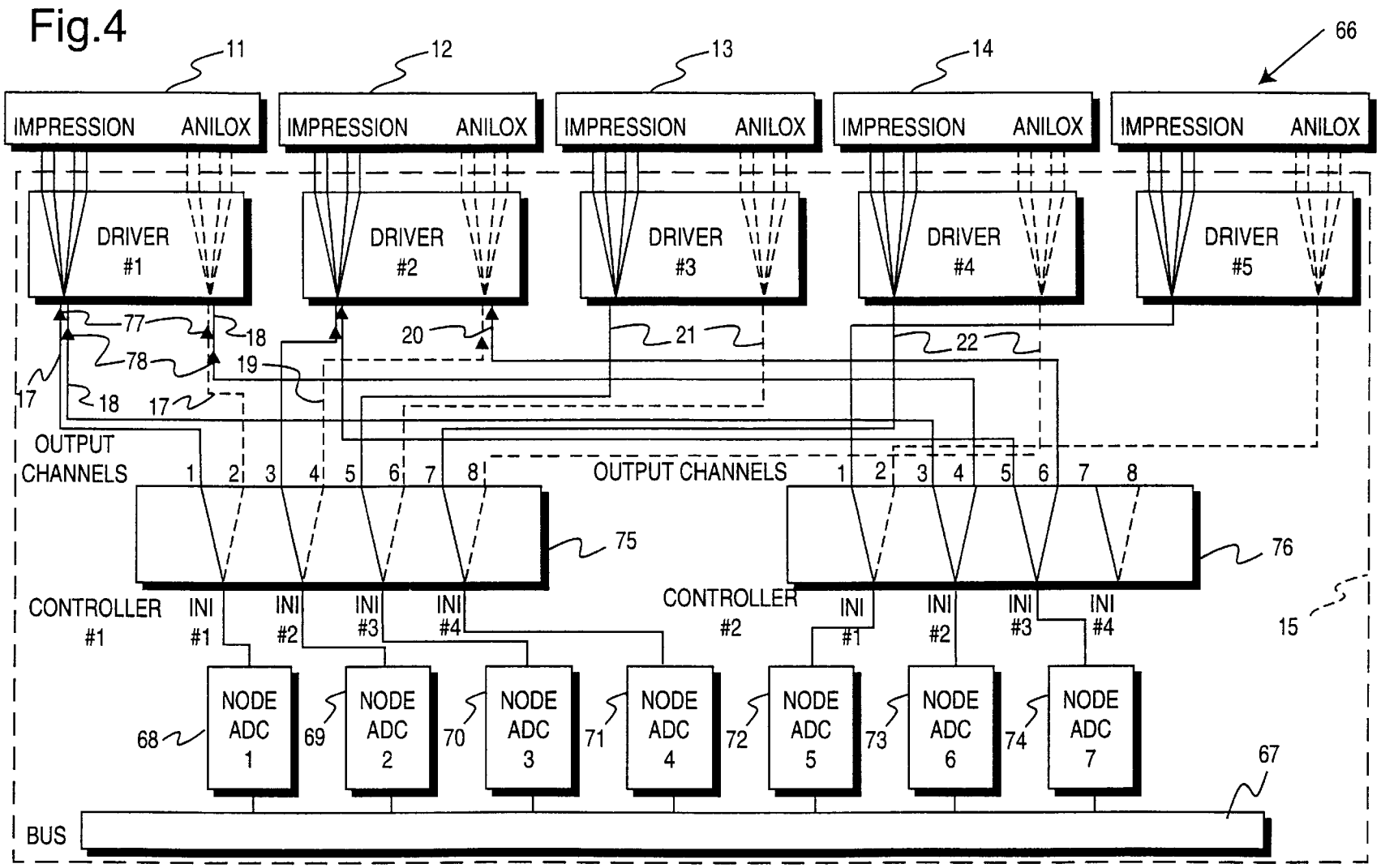
FIG. 4 is a schematic illustrating the interconnection between the computer control and flexographic printing as according to the printing assembly of the present invention.

FIG. 4 is a more detailed schematic illustrating the interconnection between the flexographic print units 11–14 and components of the computer control 15. In FIG. 4 a fifth flexographic print unit is also illustrated generally by reference numeral 66.

As seen in FIG. 4, a bus 67 associated with the computer control 15 includes a plurality of nodes 68–74 associated therewith, which may pass through one or more control units, such as the first controller 75 and controller 76. The node 68 provides control signals through the path/mechanism 17 (including two diodes 77) to control the first printing at 11 so that the plate 27 thereof stays in contact with the web 23 so as to print both plate portions 40, 41 thereof (that is a logo 51 and first text 52 as seen in FIG. 3). However, a different node 73, also acting through diodes 78, provides the control signal through the path/mechanism 18 to control the print cylinder 11 so that it is moved out of operative association with the web 23 just after the portion 40 of the plate 27 has printed the logo 51 (e.g. using a throw-off 46 or the like).

Similarly, for the embodiment of FIGS. 1 and 3, the second node 69 provides the control signal for the path/mechanism 19, again through diodes, to control the second flexographic print unit 12 so that the entire plate 27 (both portions 42 and 43 in FIG. 3) thereof print the second logo 64 and second text 54, whereas another node 74 provides the control signals through path/mechanism 20 so that the print unit 12 prints the first portion 42 (the logo 64) and then is operatively disengaged from the web 23. The node 70 provides the control signals through path/mechanism 21 to the third unit 13, while the node 71 provides the control signals to the path/mechanism 22 to the fourth unit 14, while the node 73 provides control signals to the fifth flexographic print unit 66.

It will be thus be seen that according to the present invention it is possible to eliminate a flexographic print deck for a particular job, while not eliminating its function. That is, when a job calls for just printing a particular print element, such as a logo, on just part of a form, and the rest form might be printed with other information, the invention allows elimination of a print deck with a print plate dedicated to that logo, but rather incorporates the logo (e.g. 51) printing function on a print deck (e.g. 11) having other functions (e.g. printing text 52 too). Also, the method and system according to the present invention may be revised so that under some circumstances just the portion 41 (e.g. first text 52) of the print cylinder 26,11 prints (similarly for the portion 43 for the cylinder 26, 12), and other variations are also possible within the scope of the invention. Thus, the invention is to be accorded the broadest interpretation of the appended claims so as to encompass all equivalent assemblies and methods.

What is claimed is:

1. A method of printing a web of paper using a plurality of flexographic print units, each having a flexible material print plate with a predetermined plate length, and for printing a substantially full form depth, and using a computer control for the flexographic print units, at least a first of the flexographic print units printing plate having first and second continuous distinctly different print portions over the full form depth plate length, said method comprising:

(a) at some points in time, sending print commands from the computer control unit to the flexographic print units, including the first flexographic print unit, to print the web with substantially the predetermined plate length thereof; and (b) at different points in time sending a print command from a computer control to the first flexographic print unit to print the web with only the first print portion thereof, so that only part of a full form depth is printed by the first component, moving the first unit plate out of operative contact with the web after the first print portion of the first unit plate prints the web.

2. A method as recited in claim 1 further comprising (c) sending a command from the computer control to another of the flexographic print units, besides the first flexographic print unit, to print that part of the full form depth not printed with just the first print portion of the first print unit.

3. A method as recited in claim 2 wherein a second of the flexographic print units has a second printing plate having first and second continuous distinctly different portions over the predetermined length thereof; and wherein (a) is practiced for the second flexographic print unit; and further comprising (d) at some points in time sending a print command from the computer control to the second flexographic print unit to print the web with only the first print portion of the second print plate so that only part of the full form depth is printed thereby, the second print unit print plate then moving out of operative contact with the web.

4. A method as recited in claim 3 further comprising (e) sending a command from the computer control to another of the flexographic print units besides the first and second flexographic print units to print that part of the form not printed by the first print plate portion of the second flexographic print unit.

5. A method as recited in claim 1 wherein a second of the flexographic print units has a second printing plate having first and second continuous distinctly different portions over the predetermined length thereof; and wherein (a) is practiced for the second flexographic print unit; and further comprising (c) at some points in time sending a print command from the computer control to the second flexographic print unit to print the web with only the first print portion of the second print plate so that only part of the full form depth is printed thereby, the second print unit print plate then moving out of operative contact with the web.

6. A method as recited in claim 5 further comprising (d) sending a command from the computer control to another of the flexographic print units besides the first and second flexographic print units to print that part of the form not printed by the first print plate portion of the second flexographic print unit.

7. A method as recited in claim 1 wherein (b) is practiced in part by actually physically disengaging the first flexographic print unit print plate from the web after the first print portion thereof has printed the web.

8. A method as recited in claim 1 wherein steps (a) and (b) are practiced to print bills, and further comprising acting on the web to separate each of the form depths into a separate sheet prior to sending a bill to a customer.

9. A method as recited in claim 1 wherein (b) is practiced to print a company or organization logo as the first print portion.

10. A method as recited in claim 5 wherein (b) is practiced by printing a company or organization first logo portion of a first color with the first flexographic print unit first plate portion, and wherein (d) is practiced by printing a second portion of a company organization logo with a second color, different than the first color, and intermeshing with the first logo portion, with the second flexographic print unit print plate first portion.

11. A method as recited in claim 4 wherein (b) is practiced by printing a company or organization first logo portion of a first Color with the first flexographic print unit first plate portion, and wherein (d) is practiced by printing a second portion of a company organization logo with a second color, different than the first color, and intermeshing with the first logo portion, with the second flexographic print unit print plate first portion.

12. A method as recited in claim 3 wherein (b) is practiced by printing a company or organization first logo portion of a first color with the first flexographic print unit first plate portion, and wherein (d) is practiced by printing a second portion of a company organization logo with a second color, different than the first color, and intermeshing with the first logo portion, with the second flexographic print unit print plate first portion.

13. A printing assembly comprising:

a plurality of flexographic print units each comprising an anilox roll, an impression cylinder and a plate cylinder having a flexible material plate, each plate having a plate length substantially corresponding to a full form length;

a web passing through said flexographic print units between said impressing cylinder and plate cylinder of each;

means for operatively moving said plates mounted by said print cylinders into and out of print contact with said web to thereby either print or not print said web with each said plate;

a computer control for sending print commands to each of said flexogrpahic print units moving means to selectively move said plates of each into or out of operative contact with said web, said computer control having a plurality of distinct nodes;

at least a first of said print units having said plate thereof with first and second continuous distinctly different print portions each with a length significantly less than said full form depth; and said computer control having first and second distinct nodes of said plurality of nodes connected to said first flexographic print unit, said first node for sending a print command to said first flexographic print unit which effects printing of a substantially full form depth with said first unit print plate, and said second node for sending a print command to said first print unit which causes only said first portion of said first unit plate to print said web less than a full form depth, and then for said first print unit print plate to move out of operative engagement with said web.

14. A printing assembly as recited in claim 13 wherein a second of said flexographic print units has said plate thereof with first and second continuous distinctly different portions each with a length significantly less than said full form depth; and wherein said computer control has third and fourth distinct nodes of said plurality of nodes connected to said second flexographic print unit, for sending a print command to said second flexographic print unit which effects printing of a substantially full form depth with said second unit print plate, and said fourth node for sending a print command to said second print unit which causes only said first portion of said second unit plate to print said web, less than a full form depth, and then for said second print unit print plate to move out of operative engagement with said web.

15. A printing assembly as recited in claim 14 wherein said plurality of flexographic print units comprises at least two additional flexographic printing units besides said first and second flexographic prints, each of said other flexographic print units having a dedicated node of said computer control connected thereto.

16. A printing assembly as recited in claim 13 wherein said means for operatively moving said plates mounted by said print cylinders into and out of print contact with said web comprising means for actually mechanically moving said plates out of contact with said web.

17. A printing assembly as recited in claim 16 wherein said means for actually moving said plates out of contact with said web comprise throw-offs.

18. A printing assembly as recited in claim 13 wherein each flexographic print unit comprises an ink metering roll engaging an anilox roll, an impression cylinder, a plate cylinder having a flexible material plate around at least part of the periphery thereof, said plate on said plate cylinder engaging said anilox roll, and said paper web passing between said plate on said plate cylinder and said impression cylinder.

19. A printing assembly as recited in claim 14 wherein said first print portions of said first and second flexographic print units have indicia comprising intermeshing portions of a company or organization logo; and wherein said first flexographic print image is supplied with ink of a first color, and said second unit is provided with ink of a second color distinctly different than said first color.

20. A printing assembly as recited in claim 19 wherein each flexographic print unit comprises an ink metering roll engaging an anilox roll, an impression cylinder, a plate cylinder having a flexible material plate around at least part of the periphery thereof, said plate on said plate cylinder engaging said anilox roll, and said paper web passing between said plate on said plate cylinder and said impression cylinder.

* * * * *